US009202342B2

(12) United States Patent
Casey

(10) Patent No.: US 9,202,342 B2
(45) Date of Patent: Dec. 1, 2015

(54) VIDEO POKER SYSTEM AND METHOD

(71) Applicant: Brian Casey, Reno, NV (US)

(72) Inventor: Brian Casey, Reno, NV (US)

( * ) Notice: Subject to any disclaimer, the term of this patent is extended or adjusted under 35 U.S.C. 154(b) by 137 days.

(21) Appl. No.: 14/173,767

(22) Filed: Feb. 5, 2014

(65) Prior Publication Data

US 2014/0235310 A1 Aug. 21, 2014

Related U.S. Application Data

(60) Provisional application No. 61/767,296, filed on Feb. 21, 2013.

(51) Int. Cl.

| | |
|---|---|
| ***G07F 17/00*** | (2006.01) |
| ***G07F 19/00*** | (2006.01) |
| ***G07F 17/32*** | (2006.01) |

(52) U.S. Cl.

CPC ..... *G07F 17/3293* (2013.01); *G07F 17/326* (2013.01)

(58) Field of Classification Search

CPC ..... G07F 17/326; G07F 17/3293; A63F 1/00; A63F 2001/005; A63F 3/00157

See application file for complete search history.

(56) References Cited

U.S. PATENT DOCUMENTS

| | | | | |
|---|---|---|---|---|
| 5,882,260 | A * | 3/1999 | Marks et al. | 463/13 |
| 5,971,849 | A * | 10/1999 | Falciglia | 463/16 |
| 7,614,946 | B2 * | 11/2009 | Nicely | 463/13 |
| 7,785,182 | B2 * | 8/2010 | Thomas et al. | 463/11 |
| 8,647,186 | B1 * | 2/2014 | Nottke | 463/13 |
| 2003/0107175 | A1 * | 6/2003 | Loewenstein et al. | 273/292 |
| 2004/0033824 | A1 * | 2/2004 | Fitzhugh | 463/13 |
| 2004/0072605 | A1 * | 4/2004 | Toyoda | 463/16 |
| 2006/0082064 | A1 * | 4/2006 | Caterinicchio et al. | 273/292 |
| 2006/0255541 | A1 * | 11/2006 | McBride | 273/292 |
| 2007/0126180 | A1 * | 6/2007 | Dodge | 273/292 |
| 2009/0247253 | A1 * | 10/2009 | Leland | 463/13 |

* cited by examiner

*Primary Examiner* — Milap Shah
(74) *Attorney, Agent, or Firm* — Marc D. Foodman

(57) ABSTRACT

An electronic gaming machine configured to allow play of at least two hands of video poker where the two hands intersect and share a common card between the hands. The electronic gaming machine comprises at least one display device, at least one input device, a memory and at least one computer processor configured to display at least a first hand and a second hand of at least three cards. After the at least two hands are displayed, the player is provided an opportunity to slide the cards in either or both hands to select the common card shared between the two hands to optimize the combination of cards in either or both hands.

9 Claims, 16 Drawing Sheets

VIDEO POKER SYSTEM AND METHOD

RELATED APPLICATION INFORMATION

This application claims priority benefit from U.S. Provisional Application No. 61/767,296, filed on Feb. 21, 2013.

COPYRIGHT NOTICE

Portions of this disclosure contain material in which copyright is claimed by the applicant. The applicant has no objection to the copying of this material in the course of making copies of the application file or any patents that may issue on the application, but all other rights whatsoever in the copyrighted material are reserved.

BACKGROUND

The present invention relates generally to card games and methods thereof, and more particularly, to a method of playing multiple hands of draw poker that would provide players with an interactive ability to move hands or cards separately to create the best possible combination of cards to form a winning hand.

What makes video poker different from playing poker against other players in a live game is the use of paylines to determine a winning outcome. The amount the player wagers also affects the amount a player may win given a winning combination of cards. Generally, a player has the opportunity to win a larger award as the wager increases.

Casino operators are always looking for new and innovative ways to increase the level of enjoyment and interaction of casino-style games with casino patrons. Conventional gaming machines or devices have traditionally used spinning reels or standard video poker games as methods to provide casino patrons a method of wagering.

Standard five card draw video poker has been available in legal gaming jurisdictions for many years. The number of games along with variations in paytables and the addition of wild cards have also been introduced over the years. More recently, poker games utilizing multiple lines of cards and unique play attributes have grown more popular as players demand a greater level of interaction than that offered in standard five card draw poker. Some variations also include the ability to duplicate held cards from an initial draw of five cards to other lines or hands. Although this has created the opportunity for increased wagers and opportunity for increased winning outcomes, these variations typically rely on the duplication of initial draws of cards to create additional poker hands.

Electronic gaming machines ("EGMs") are extremely popular with casino patrons for playing slot games and video poker games. Over the years, video poker games have provided players with a high level of entertainment. In some forms, video poker implements the use of multi-hands, thereby connecting play of hands through different techniques. Multi-hand play challenges a player to employ optimum play strategy to maximize the number of wins and the value of the wins over multiple hands.

One common feature of video poker games, including multi-hand games, is that each separate poker hand is played from a standard individual deck with 52 cards. This means that it is difficult for the player to predict with a high probability what cards of those remaining in the deck will be dealt in the initial hand or on the draw. In a typical video poker game, a player is initially dealt five cards. The player can replace any number of the five dealt cards up to and including all five cards. That means that the probability of predicting the draw cards is no better than five out of 47 and that assumes that all five cards dealt on the initial deal are discarded. The probability changes to four in 47, three in 47, two in 47 or one in 47 depending on the number of cards held before the draw. Experienced poker players understand the probabilities and the pay tables associated with their favorite games and seek to employ optimal strategies for obtaining a low frequency, high pay for a hand like a royal flush or four-of-a-kind, or alternatively, a high frequency, low pay for a hand like two face cards.

Accordingly, there is a need for video poker systems and games that provide players with higher predictability of final hands and greater excitement throughout the playing experience. There is also a need to encourage players to play more often or for longer periods while giving the player the opportunity for paybacks that happen with greater frequency or in higher amounts. Further, there is a need for systems and methods that give players the chance to employ a variety of play strategies to make the experience more fun and exciting. These and other features of the system and method disclosed herein will become more readily apparent from the following description.

BRIEF DESCRIPTION OF THE DRAWINGS

For a better understanding of the present invention, and to show more clearly how it functions, reference will now be made, by way of example, to the accompanying drawings. The drawings show embodiments of the present invention in which.

DETAILED DESCRIPTION

Figure 1A:
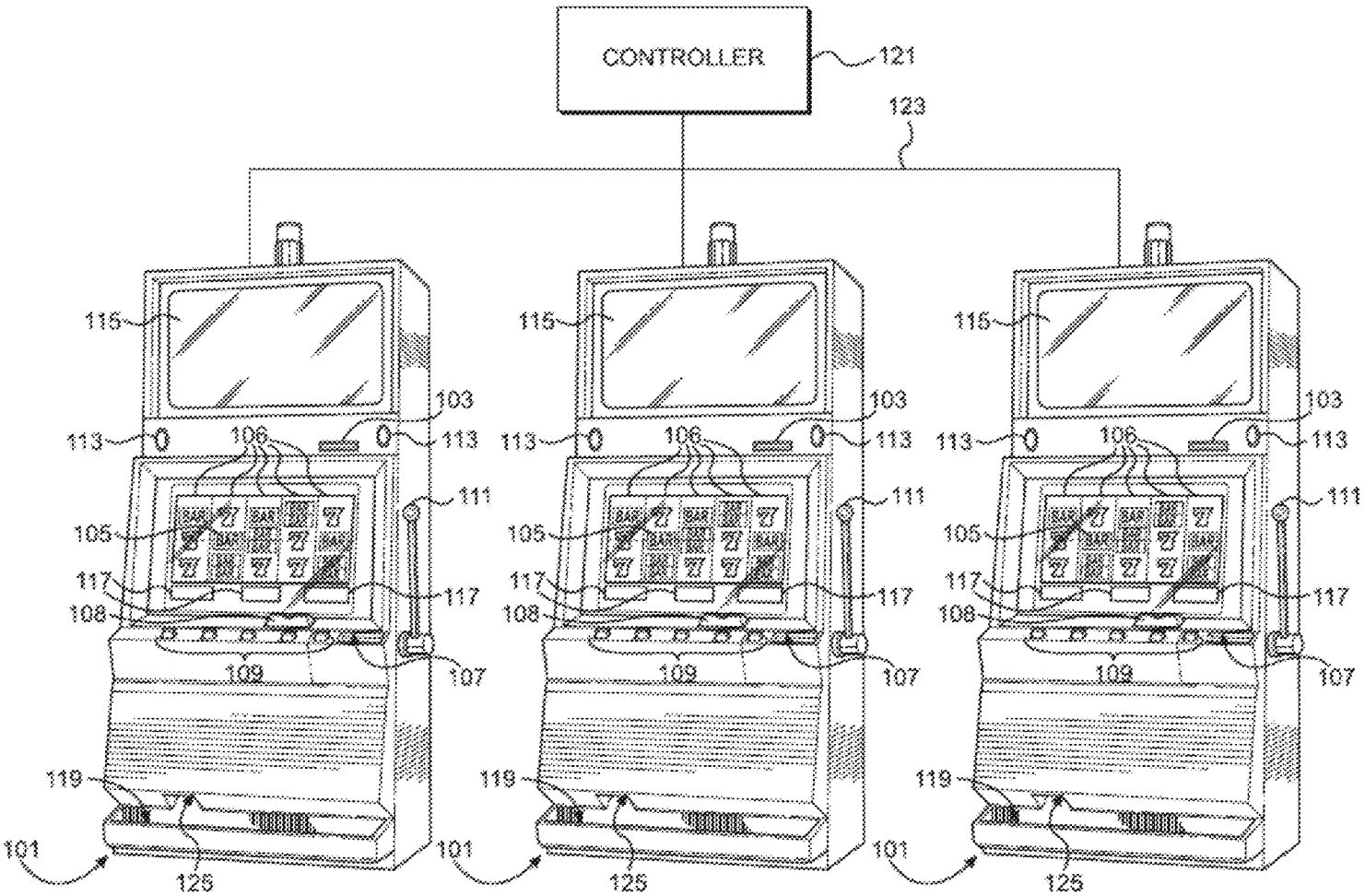
FIG. 1A PRIOR ART
FIG. 1A shows electronic gaming machines for playing a game connected to a network controlled by a server.

The following description provides details with reference to the accompanying drawings. It should be understood that the invention may be embodied in many different forms and should not be construed as limited to the embodiments set forth herein. Throughout FIGS. 1-13, like elements of the invention are referred to by the same reference numerals for consistency purposes. The system and method described herein may be implemented on an electronic gaming machine for use in a casino gaming facility at a stand-alone video poker machine, a live table game or an electronic table game with a live or video dealer. Or, alternatively, the system and method may be implemented in a live game between one or more players playing against a dealer, each other or both. The system may also be implemented as a game on a stand-alone computing device capable of playing a game, or on a networked connected computing device capable of playing a game.

The present invention is a system and method of playing poker preferably on a gaming device whereby the player can manipulate a column of cards, a row of cards, or individual cards in order to form the best possible combination for a winning hand or potential winning hand based on a given paytable and wager amount. This method of playing a video poker game is unique in that an entire row of cards, column of cards, or individual cards can be moved to a shared card in order to create the best possible combination for a winning hand or potential winning hand.

FIG. 1A shows a group of electronic gaming machines ("EGM") connected to a central controller. The EGMs pictured are electronic video slot machines, but these machines are also capable of displaying video poker or other types of video games. Each EGM 101 is a wagering device that is used in a casino and may be configured to display and play any of a number of different types of games, including but not limited to electromechanical spinning reel type slot games, video reel games, video poker, keno, roulette, craps, blackjack, or any other type of wagering game.

A group of EGMs 101 forms a bank that may be connected together for different types of system applications. For example, a group of EGMs 101 may be linked together for bonusing in a variety of ways, including progressive bonuses where a portion of an amount wagered is applied to a progressive meter that advances as additional games are played. It is also common for EGMs in a casino establishment to be connected to systems for player tracking so that the casino can keep track of the amount of play by each individual player. In that case, each player is issued a player tracking device such as a card that is inserted into a card slot 103 on EGM 101 during play. The card identifies the player to the system and all wagered amounts are tracked for loyalty rewards and other marketing programs of the casino. Other systems connecting EGMs 101 are used for accounting purposes so that a casino operator can monitor and track play, and assess performance of EGMs across the entire casino floor.

Each EGM 101 has a number of components. A display 105 is used to show game play and resulting outcomes, and may be in the form of a video display (shown), or alternatively, physical reels. Touch screen displays are included on most EGMs and provide a flexible interface for operation of EGM 101, including displaying symbols 106 during play. Other components include a bill validator and a coin acceptor that are both housed inside EGM 101 into which bills may be inserted through bill slot 107 and coins may be inserted through coin head 108, respectively. Buttons 109 on the exterior of EGM 101 are used to control certain EGM operations in conjunction with touch screen display 105. A handle 111 may be used to initiate play of a game and speakers 113 are used to provide sounds in conjunction with game play and other EGM operations. EGMs further include a top box 115 for displaying pay tables, artwork, advertising or other types of information either on fixed glass or on other displays such as an integrated video panel. Top box 115 may be fitted with a liquid crystal display ("LCD") screen to permit aspects of game play from either a base game or a secondary game to be shown in top box 115. Meters 117 for tracking credits available for play and other amounts are positioned near the bottom of screen 105. A coin tray 119 at the bottom of EGM 101 is used to catch coins as they are dispensed to a player. It is also common for EGM 101 to include a ticket-in, ticket-out ("TITO") components that may be integrated with the bill validator housed inside of EGM 101 that may accept bar coded credits through slot 107 and for which the value of the credits is displayed on meters 117 upon a ticket being inserted.

All operational functions of EGM 101 are controlled by a controller such as a microprocessor housed inside EGM 101. The controller executes instructions that include operation of a random number generator ("RNG"). The controller and the RNG are components that are both well known to those of ordinary skill in the art. Game outcomes are determined based on the results corresponding to the numbers selected by the RNG.

Figure 2A:
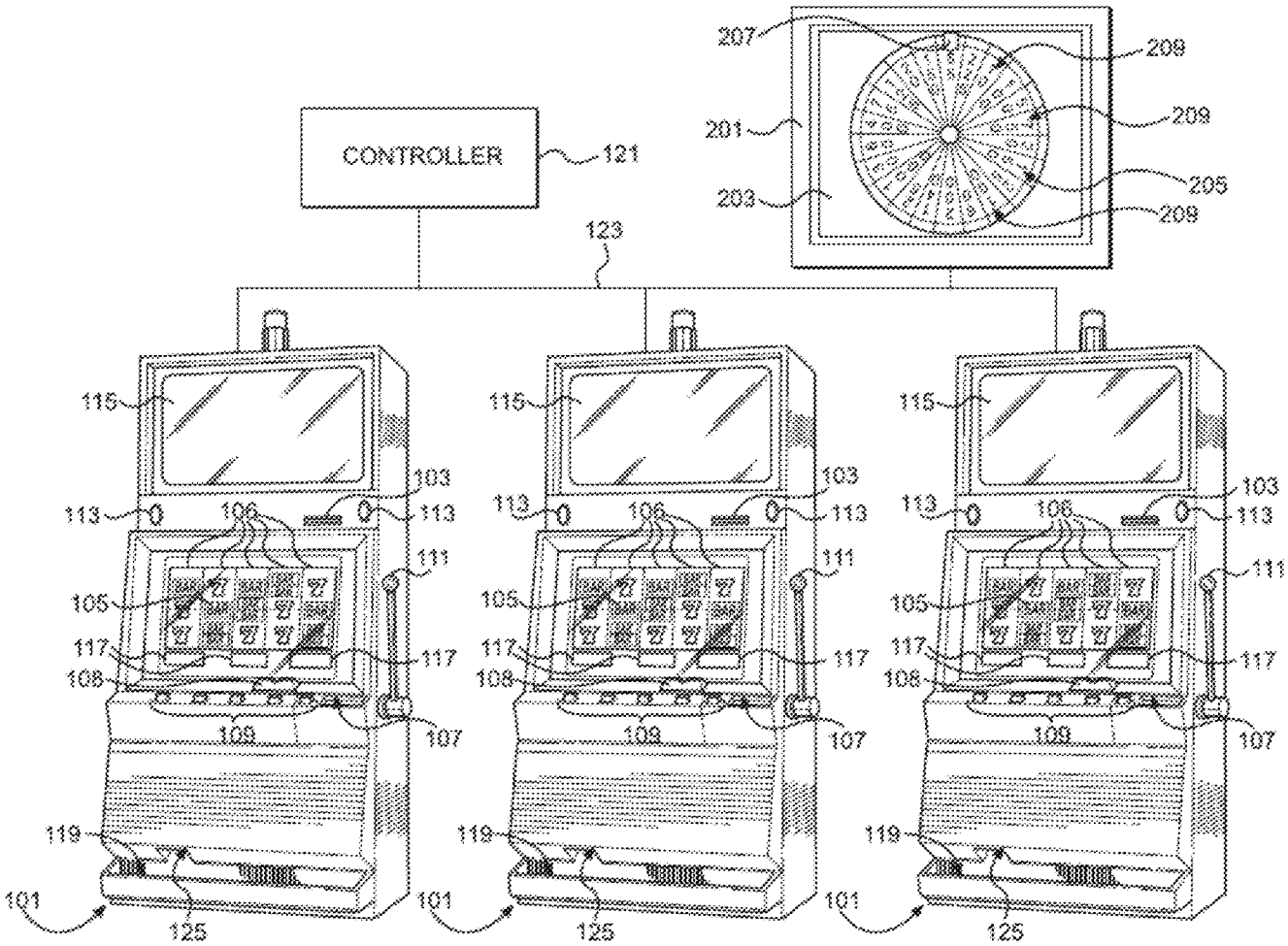
FIG. 2A PRIOR ART
FIG. 2A shows electronic gaming machines for playing a game connected to a network controlled by a server and including a networked bonus game display.

In the system of FIG. 1A, EGMs 101 are connected to a controller 121 that is used to interface with EGMs 101 to perform a number of different functions, depending on how games on EGMs 101 are configured to operate. For example, controller 121 may instruct EGMs 101 to dispense cash bonuses based on winning events on a networked bonus feature such as a bonus wheel 201 as shown in FIG. 2A. Controller 121 is a microprocessor based device such as a computer or server that is in two-way communication with each of the EGMs 101 in a multi-device system over a network connection 123. Controller 121 receives signals from EGM 101 that may indicate any of a number of different types of events occurring on EGM 101.

Figure 1D:
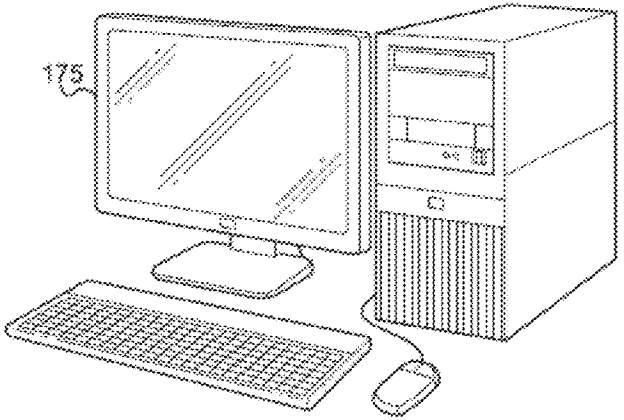
FIGS. 1B-1F show computing devices for playing a game.
Figure 1F:
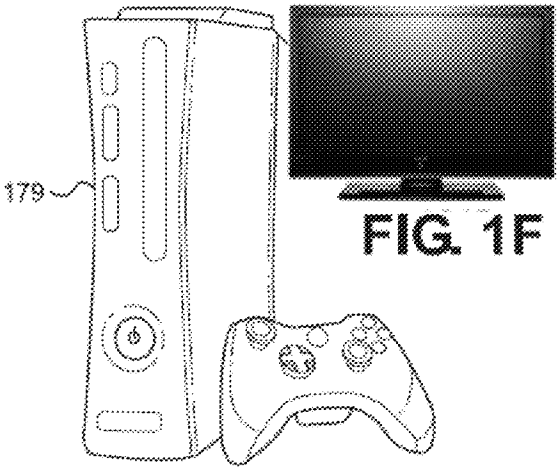
Figure 1C:
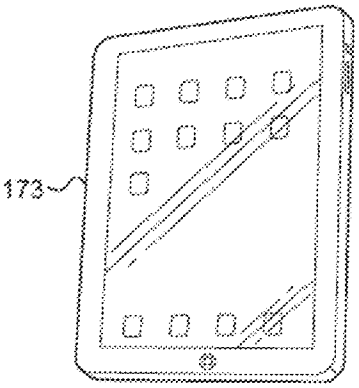
Figure 1B:
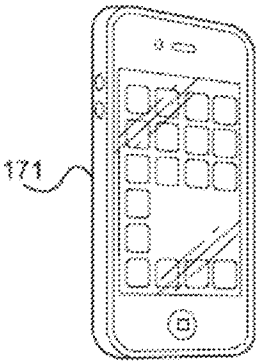
Figure 1E:
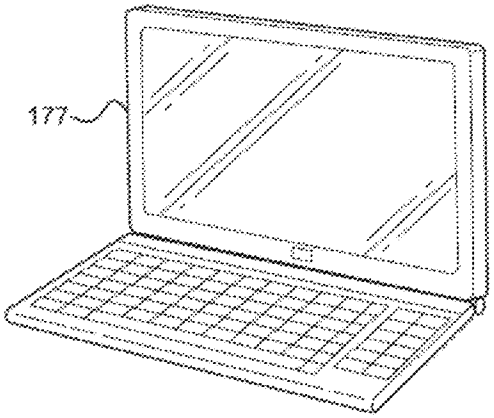
FIG. 1E PRIOR ART

FIGS. 1B-1F show a number of general purpose computing devices which may be used to play a game. These figures show a smartphone 171 in FIG. 1B which may be an Apple iPhone 45® as pictured, or any other mobile phone type device. A tablet computer 173 is shown in FIG. 1C which may be an Apple iPad 3® as pictured, or any other tablet computing device. A desktop computer 175 is shown in FIG. 1D which may be a Lenovo® machine as pictured, or any other desktop computer. A laptop computer 177 is shown in FIG. 1E which may be a Lenovo® computer or any other laptop computer. And, a home video gaming device 179 is shown in FIG. 1F which may be a Microsoft Xbox® system or any other home video system. Other types of network connected devices could also be used to play games including portable video gaming devices such as a Sony PSP®, a Nintendo GameBoy®, or an internet connected television with a browser or app capabilities. Any of these devices is capable of playing a game, including a wagering game, through an app loaded onto the device or through a website accessible using a browser on the device. In the case of the networked game, payment may be made by credit card, Paypal® or another payment service. The RNG is run securely on a server based system and then delivers the outcomes over the internet to be displayed on the general purpose computing device.

FIG. 2A shows a group of EGMs 101 and controller 121 connected on network 123 along with a bonus device 201. Bonus device 201 is in the form of a wheel 203 with different potential winning outcome amounts 205 shown on it. Bonus device 201 also includes an indicator 207 to indicate the winning position when wheel 203 comes to a stop. Prize values 209 or other symbols representing different outcomes are shown in the different positions or segments of wheel 203. It should be understood that bonus device 201 may alternatively be a screen for displaying a bonus indicator such as a wheel or any other indicator representation. Further, bonus device 201 may alternatively be incorporated in the housing of EGM 101 such as in top box 115, or it may be a separate device situated nearby to EGM 101 and shared by more than one EGM 101 so that it may be displayed prominently for visitors to a casino establishment to see thereby raising the excitement level for the player playing and the other casino customers. Bonus device 201 may take the form of any bonus indicator, a variety of which are known, including but not limited to reels, "pick a prize" reveal type bonus indicators, timers, arrows, etc. Bonus device 201 may also be in the form of a dedicated device specifically designed for a particular type of bonus, such as a wheel.

In FIG. 2A, EGM 101 is shown as a casino gaming device of the type depicted in FIG. 1A. It should be understood that any one or more of the general purpose computing devices of FIG. 1B-1F—smartphone 171, tablet computer 173, desktop computer 175, laptop computer 177, or home video gaming system 179 shown in FIGS. 1B-1F—could be placed on a network connected to server based system 221 and used to deliver a game as described herein. For purposes of this specification, reference to one or more EGMs 101 in an environment using a limited access intranet of the type typically found in a casino would also apply to one or more general purpose computing devices with a secure connection to a server over the internet and not involving a physical casino property at all, and which may or may not require a wager or payment to play. The term electronic gaming machine or EGM shall refer to any device capable of playing a game.

Figure 2B:
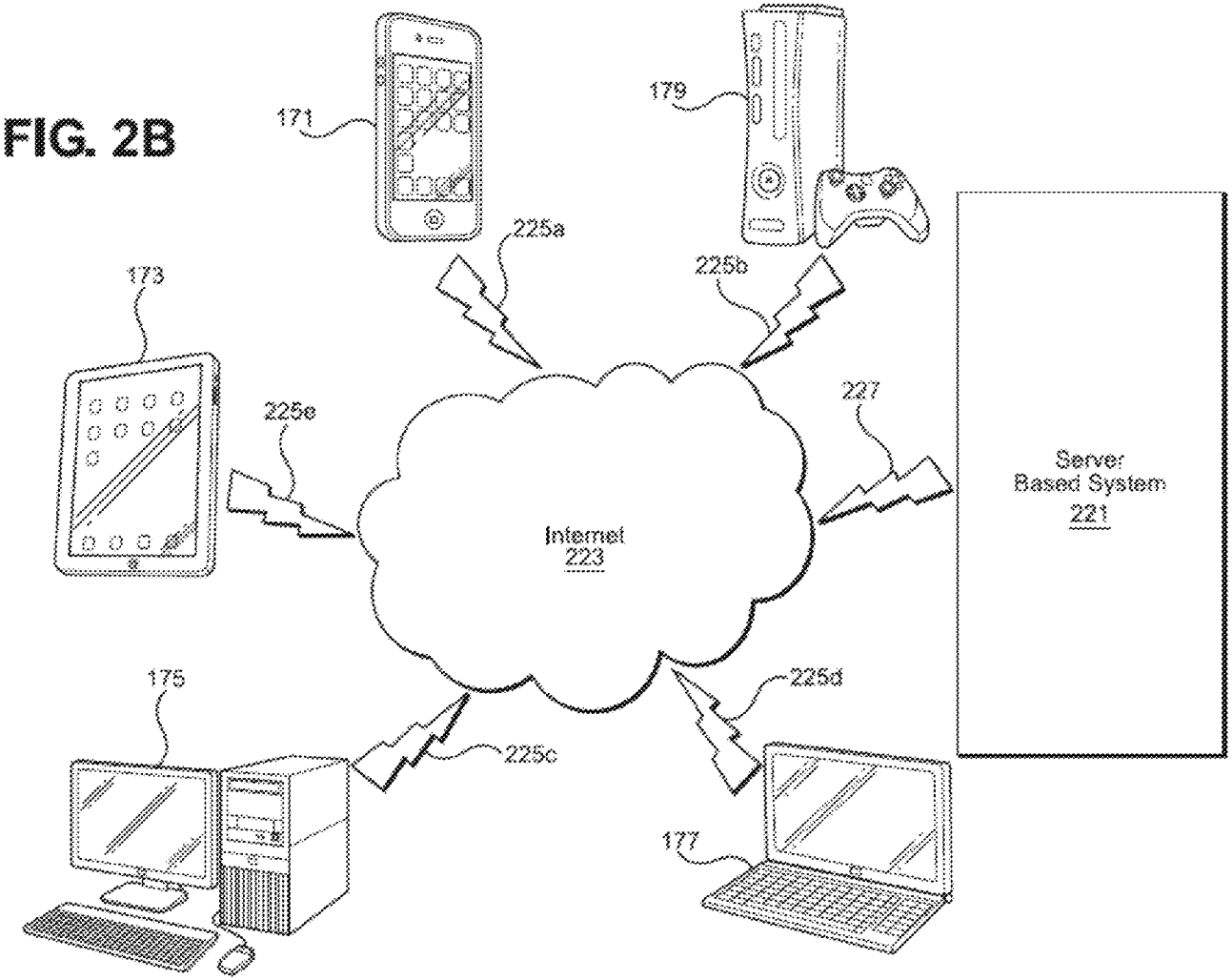
FIG. 2B PRIOR ART
FIG. 2B shows a group of electronic gaming machines on a network connected to a server based system and an external system.

FIG. 2B shows server based system 221 connected to a network with multiple computing devices for playing games. It should be understood that the network shown in FIG. 2B operates in a manner similar to the network of FIG. 2A, except that the computing devices on the network of FIG. 2B are connected over the internet 223 with each device 171-179 connected over a secure connection 225*a*-*e* to server based system 221 which connects to internet 223 over network connection 227. Payments can be made securely over internet 223 using connections 225*a*-*e*, and then delivered to an operator over connection 227. Similarly, the game is executed on server based system 221 using a secure RNG with the outcomes being delivered to the individual devices 171-179 over internet 223. Alternatively, the game software or a portion of it may be resident and executed on each device 171-179. Wagers by players and payments to players may be made using accounts set up with an operator of a website on which the games are run.

It will be understood that the type of network over which data is communicated can be one of several different types of networks. These networks include a Local Area Network (LAN), Wide Area Network (WAN), an intranet or the Internet. Other proprietary networks could also be used without departing from the principles of the invention. This would include such networks as a Windows network or an Ethernet network. Throughout FIGS. 1-3, like elements of the invention are referred to by the same reference numerals for consistency purposes.

Figure 3:
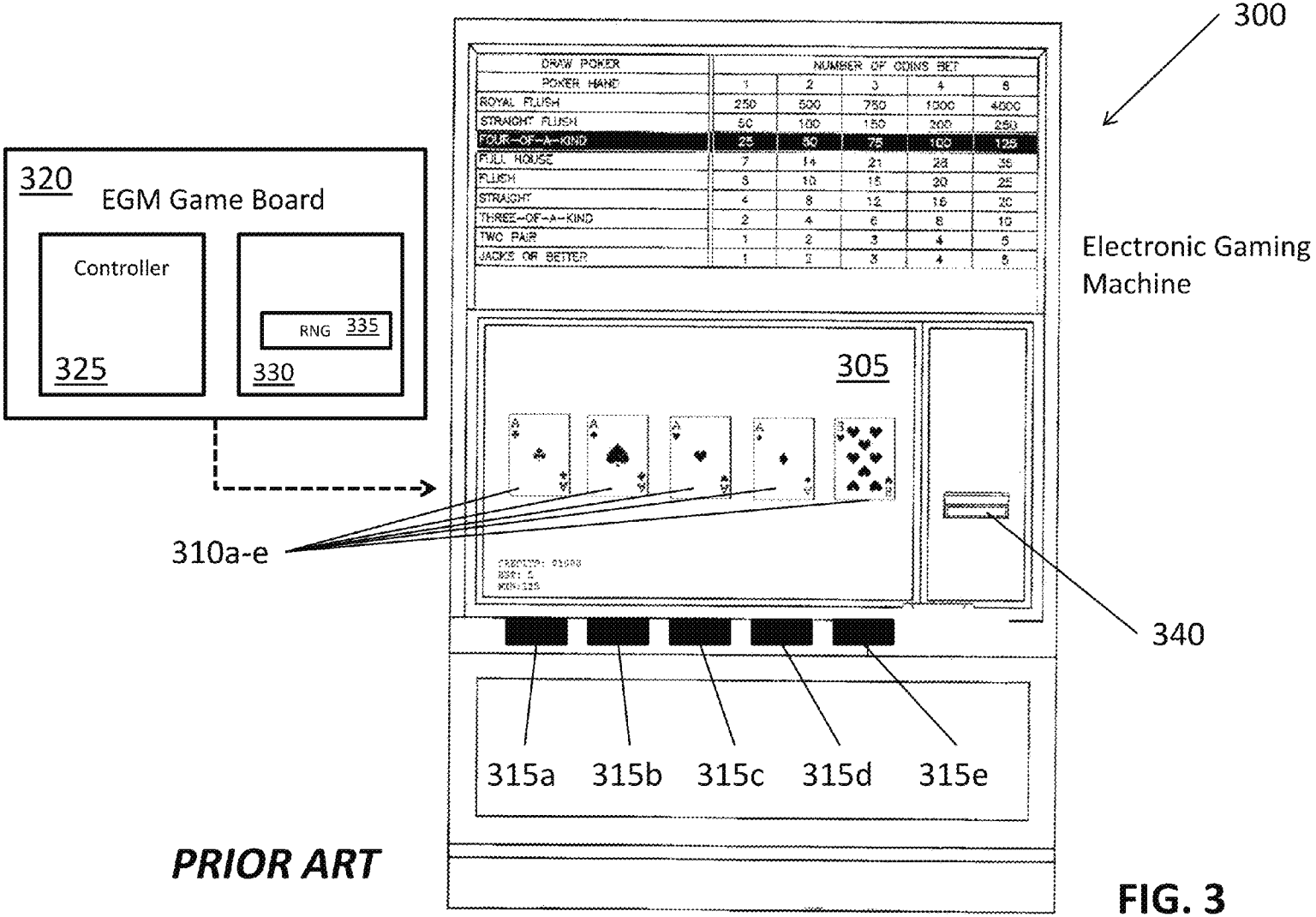
FIG. 3 PRIOR ART
FIG. 3 is an electronic gaming machine for use in the play of video poker.

FIG. 3 shows an electronic video poker gaming machine ("EGM") 300 for playing video poker having a display screen 305 for displaying cards or other symbols at positions 310*a*-*e*. A set of buttons 315*a*-*e* corresponding to card display positions 310*a*-*e* and situated on the cabinet of EGM 300 may be used by a player to provide input to EGM 300. It should be understood that different inputs may also be used. For example, display 305 may be a touch screen and buttons may appear on the screen lined up under card positions 310*a*-*e* or otherwise proximate to card positions 110*a*-*e*. A game board 320 with a controller 325 and an internal memory 330 that stores an executable game program and a software based random number generator 335 are among the internal components that allow EGM 300 to operate a video poker game or other type of game. EGM 300 also includes a device 315 for accepting wagers and making payouts to players. Device 340 is typically a note acceptor-dispenser that accepts and validates currency inserted by the player, and for dispensing currency to a player for unused credits that are either unplayed or won during a play session. Device 340 may also be configured to print tickets for an amount of credit available to the player when he no longer desires to play the machine. The tickets can be re-inserted into EGM 300 or other EGMs on the casino floor or redeemed for cash by the casino. As generally discussed above with respect to FIG. 1A, the internal components, configurations and operations of an EGM are well known to those of ordinary skill in the art.

The system and method are directed to a session of play measured in two or more hands where cards are dealt from a single deck or multiple decks stored virtually in the memory of EGM 300. In accordance with the embodiment, the deck (or multiple decks) is not reset at the beginning of each subsequent game in the session. For example, a play session may comprise five separate game plays and this detailed description is based on a five play session. It should be understood that a session may be any number of games that is two or more, but an upper limit is reached at the point where there are not enough cards in the deck (or multiple decks) from which to deal any additional cards.

Figure 4:
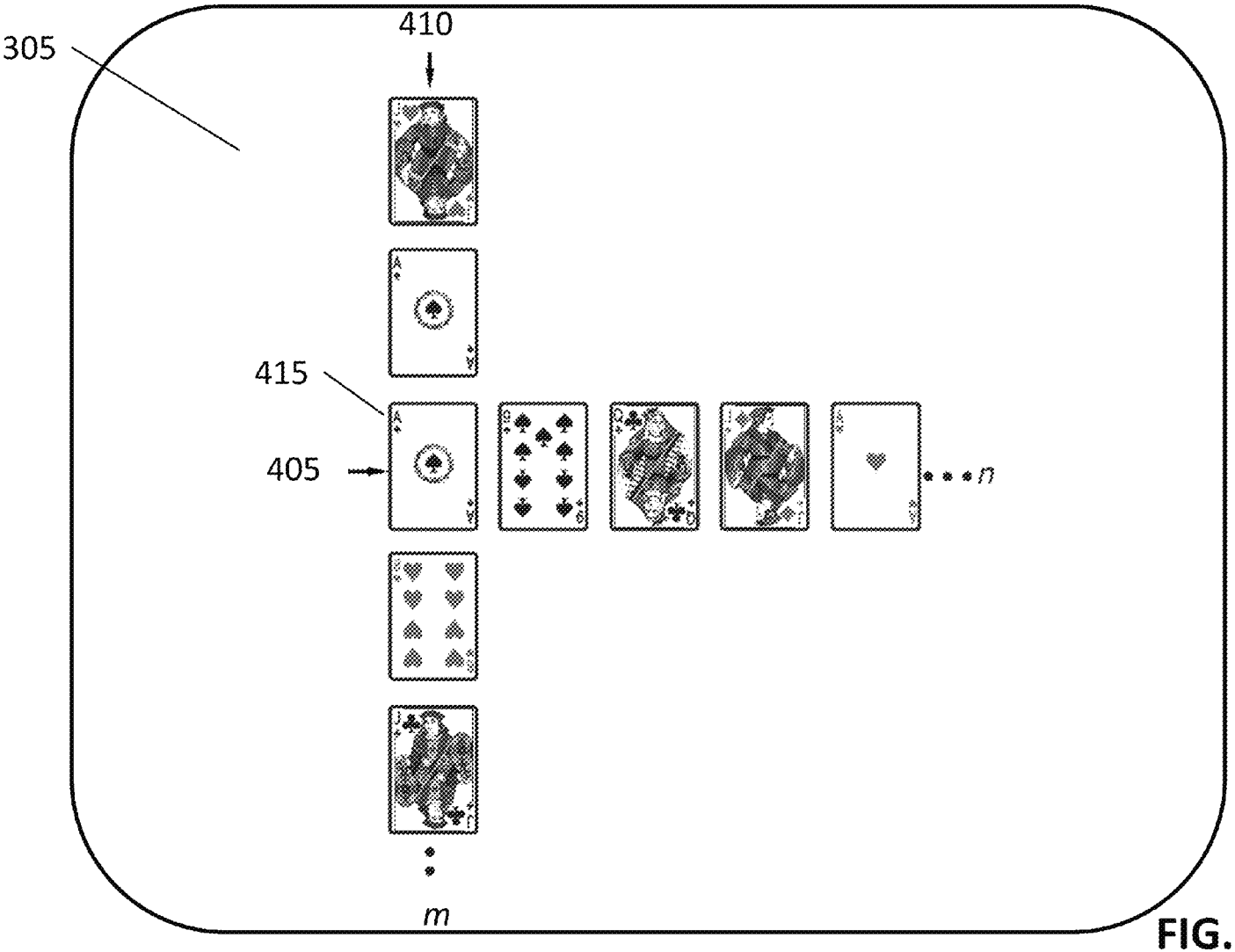
FIG. 4 shows an initial hand of n cards exposed in a row and an initial hand of m cards exposed in a column after an initial deal of five cards in each according to the present invention.
Figure 5:
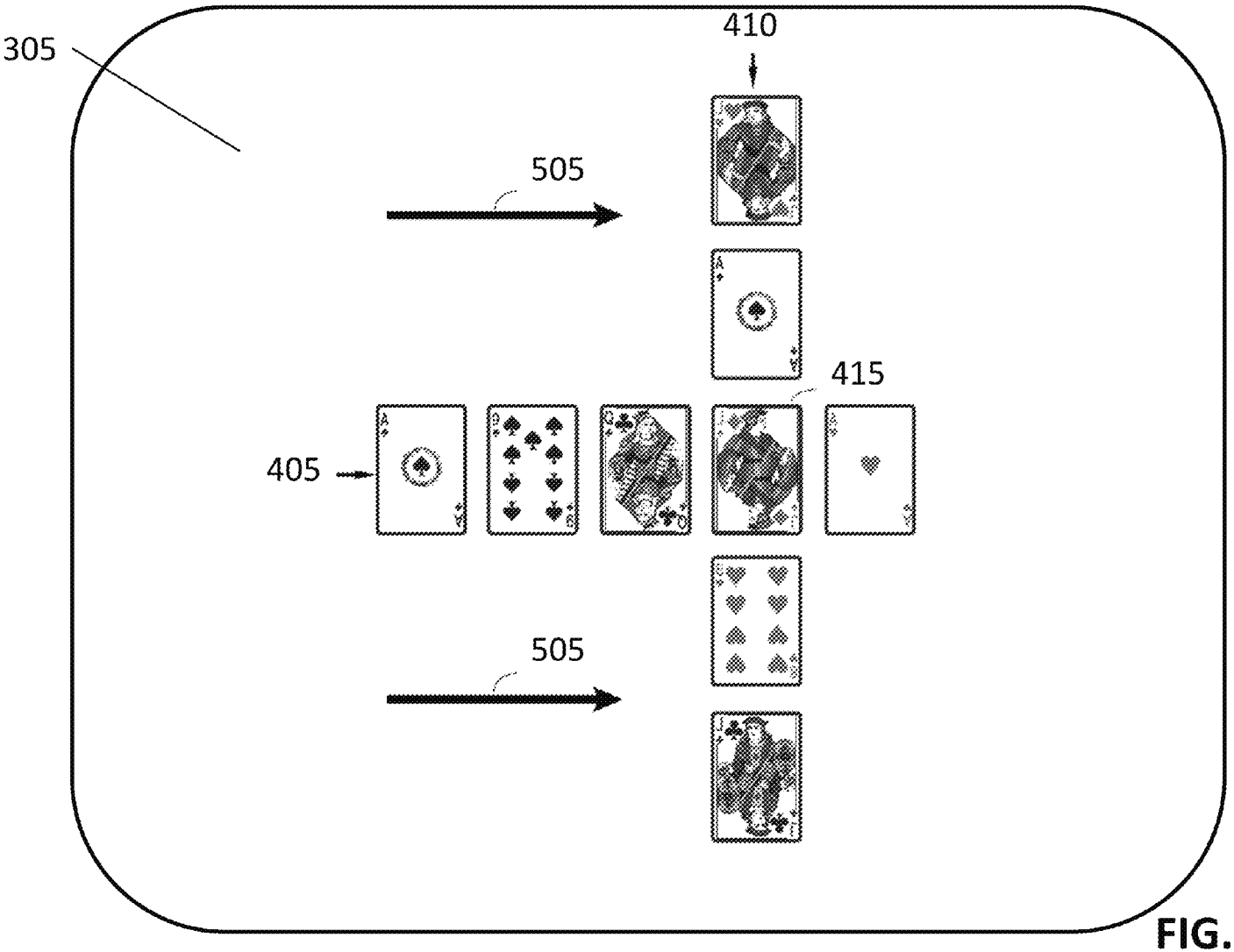
FIG. 5 shows the hands of FIG. 4 after the column of cards has been moved to a different shared card on the initial hand of five cards in the row according to the present invention.
Figure 6:
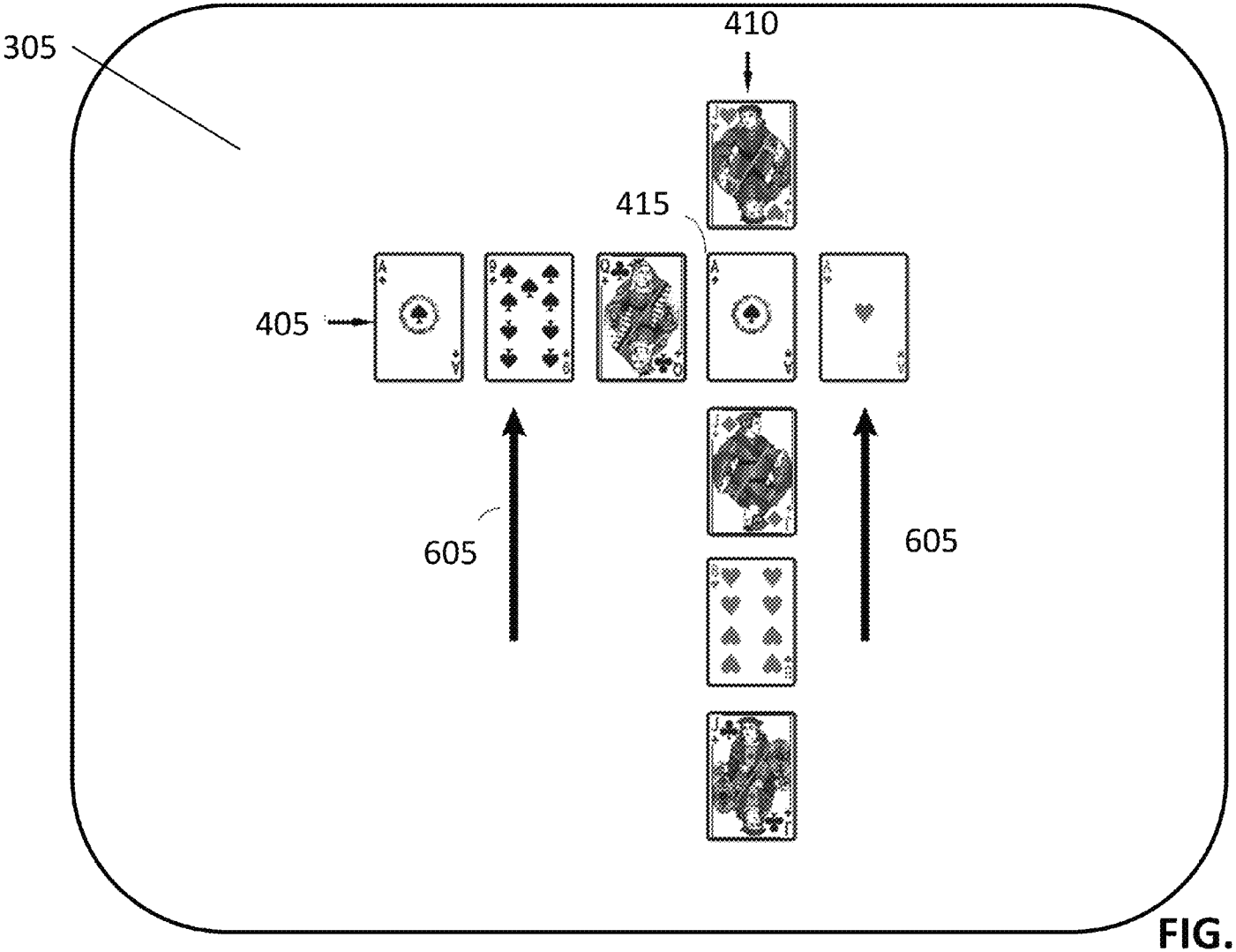
FIG. 6 shows the hands of FIG. 4 after the row of cards has been moved to a different shared card on the initial hand of five cards in the column according to the present invention.

Referring now to screen shots of an embodiment of the invention shown in FIGS. 4-8. Display 305 of EGM 300 is shown with a row of cards 405 and a column of cards 410. In this embodiment, row 405 and column 410 are dealt each from a separate standard fifty-two card deck of cards. Row of cards 405 and/or column of cards 410 are typically comprised of a hand of five cards each, but either or both may include more or fewer cards. The number of cards in row 405 is designated by "n" and the number of cards in column 410 is designated by "m" as shown in FIG. 4. Column 410 may be moved in a right or left direction as indicated by arrows 505 as shown on FIG. 5 while row 405 may each be moved in an up or down direction as indicated by arrows 605 as shown on FIG. 6. The movement of row 405 and column 410 is performed independently by the player in order for a player to form a winning combination of cards or potential winning combination of cards using a shared card 415 that is at the intersection between the row 405 and column 410.

To move row 405 and column 410 to form a winning combination, the player may use a finger to touch a row and then apply a sliding motion on touch screen 305, or by tapping a button 315 on EGM 300, or any other method to move row 405 and/or column 410 that complies with the concept of this method. The game designer may require that for a player to be provided the opportunity to move row 405 and/or column 410, the player will be charged an amount of coins or credits. Or, the opportunity to move row 405 or column 410 may be a standard feature of the game to which the player is entitled as part of regular play without an additional wager.

Figure 7:
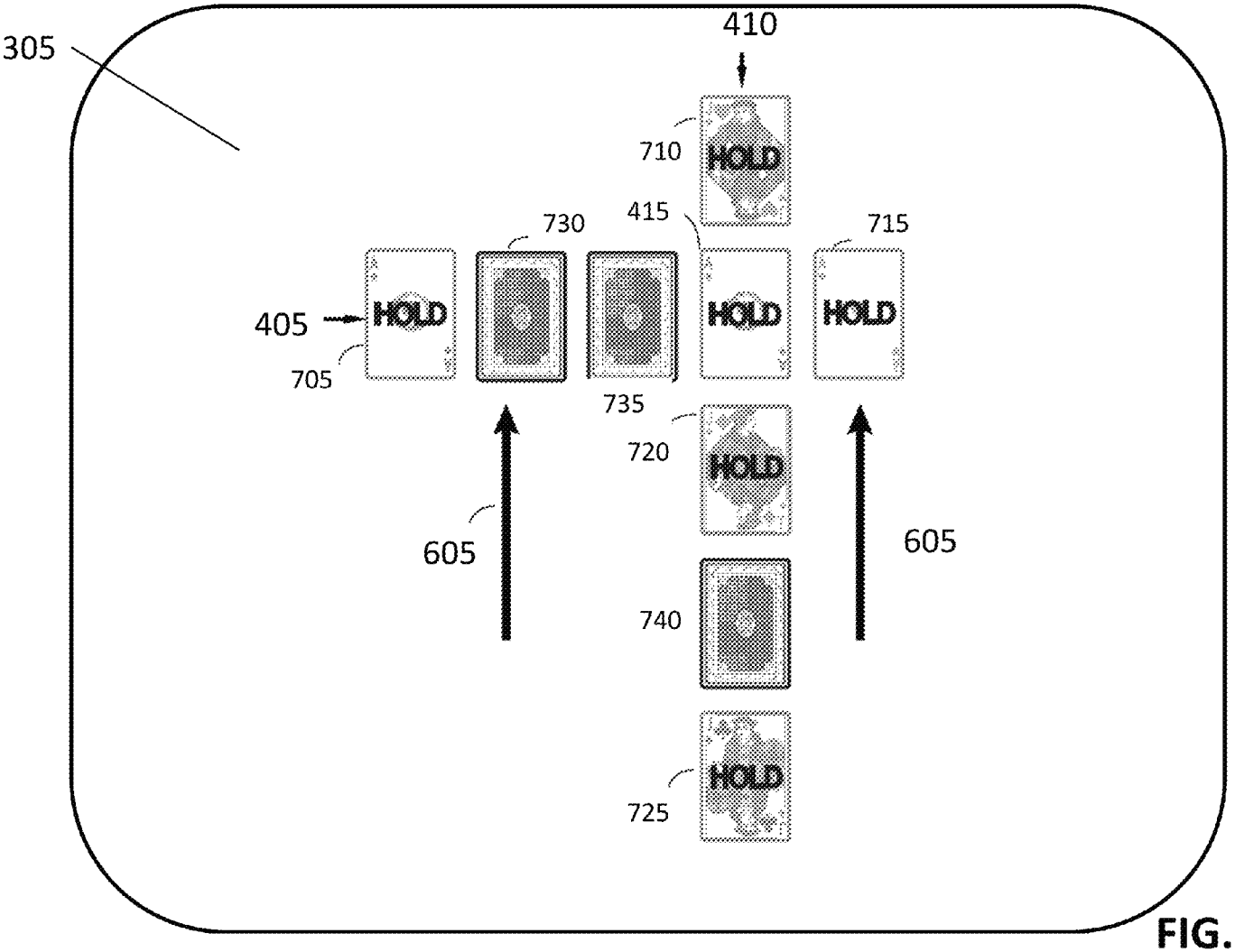
FIG. 7 shows the hands of FIG. 6 after the player selects held cards according to the present invention.
Figure 8:
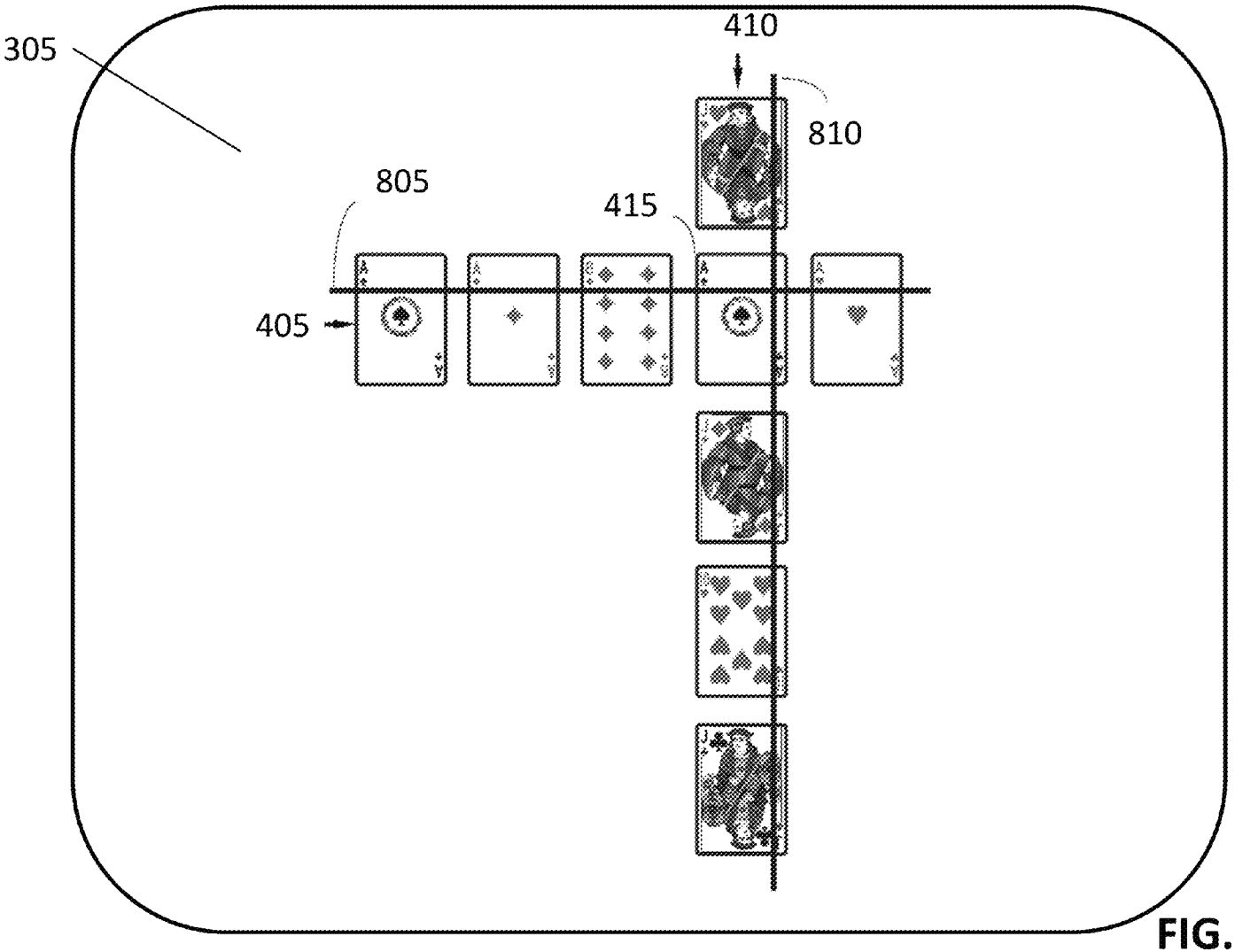
FIG. 8 shows the completed hands of FIG. 7 with cards dealt on a subsequent draw according to the present invention.

The winning combination is a function of a game paytable and the amount wagered by the player. It will be understood from the Figures that the particular card that is shared between row 405 and column 410 depends on the number of positions that row 405 and/or column 410 are moved relative to one another and the final position to which one or both are moved by the player. Once row 405 and/or column 410 are moved to the desired configuration by the player, the player then holds certain cards 705, 710, 715, 720 and 725 as shown in FIG. 7. In the example of FIG. 7, the shared card 415 is also held. It is likely that the hands formed by the player by sliding row 405 and column 410 include a desirable card at the intersection of the hands 415, but that is not necessarily always the case. This selection may be entirely decided upon by the player, or controller 325 may be set up to choose the optimum hold cards for the player based on the paytable and/or the wager.

The player makes a final decision as to which cards to hold in each of the hands in row 405 and column 410 in a manner similar to standard five card draw poker so as to form the best possible winning combination(s) or potential winning combination(s) of cards in the hands based on a paytable and wager. Draw cards shown in FIG. 7 as cards 730 and 735 are then dealt into row 405 from the same deck from which cards for row 405 were initially dealt to replace the discarded (not held) cards. A second deck which is the same deck from which cards for column 410 were initially dealt is used for the draw cards in column 410 to replace those cards discarded (not held) from the initial deal. If card 415 at the intersection of the hands is discarded (not held) after the deal, a card drawn from either deck may be replace card 415 on the draw. The draw card for card 415 may come from the deck used for row 405 or for column 410. Alternatively, it may be selected at random or, to increase player involvement and excitement, the player may be given the choice from which deck to draw the card.

Any potential winning combination of cards for each hand is analyzed on a first payline 805 for row 405 and a second payline 810 for column 410 to determine if the player has a winning hand based on a paytable and wager.

An embodiment of the invention for playing a game of draw poker may use any number of different paytables to determine a winning combination of cards. It is possible that the player achieves a losing combination of cards on one or more of the hands and achieves a winning combination of cards on one or more of the hands. Or, the player may achieve a losing combination of cards on all of the hands, or achieve a winning combination of cards on all of the hands. It should also be understood that the amount a player wagers may define the number and direction of movement 505, 605 of the cards. For example, the game may be set up so that a player may "buy" a movement of a row or column. For one or more credits, the player may be entitled to slide a row or a column by one position where multiple positions may cost additional credits. Or, a payment may entitle a player to slide a row or column by any number of positions during that turn. The amount of the charge and the number of positions to be moved is up to the game designer.

While the invention shown in FIGS. 4-8 shows the game with one row 405 and one column 410, it is also possible to design the game using two or more rows or columns of hands. Preferably, the game is played with a standard fifty-two card deck for each hand played; however, it is possible in an alternative embodiment that a non-standard deck of cards is used or just one fifty-two card deck is played for all of the hands in play at any given time.

Figure 9:
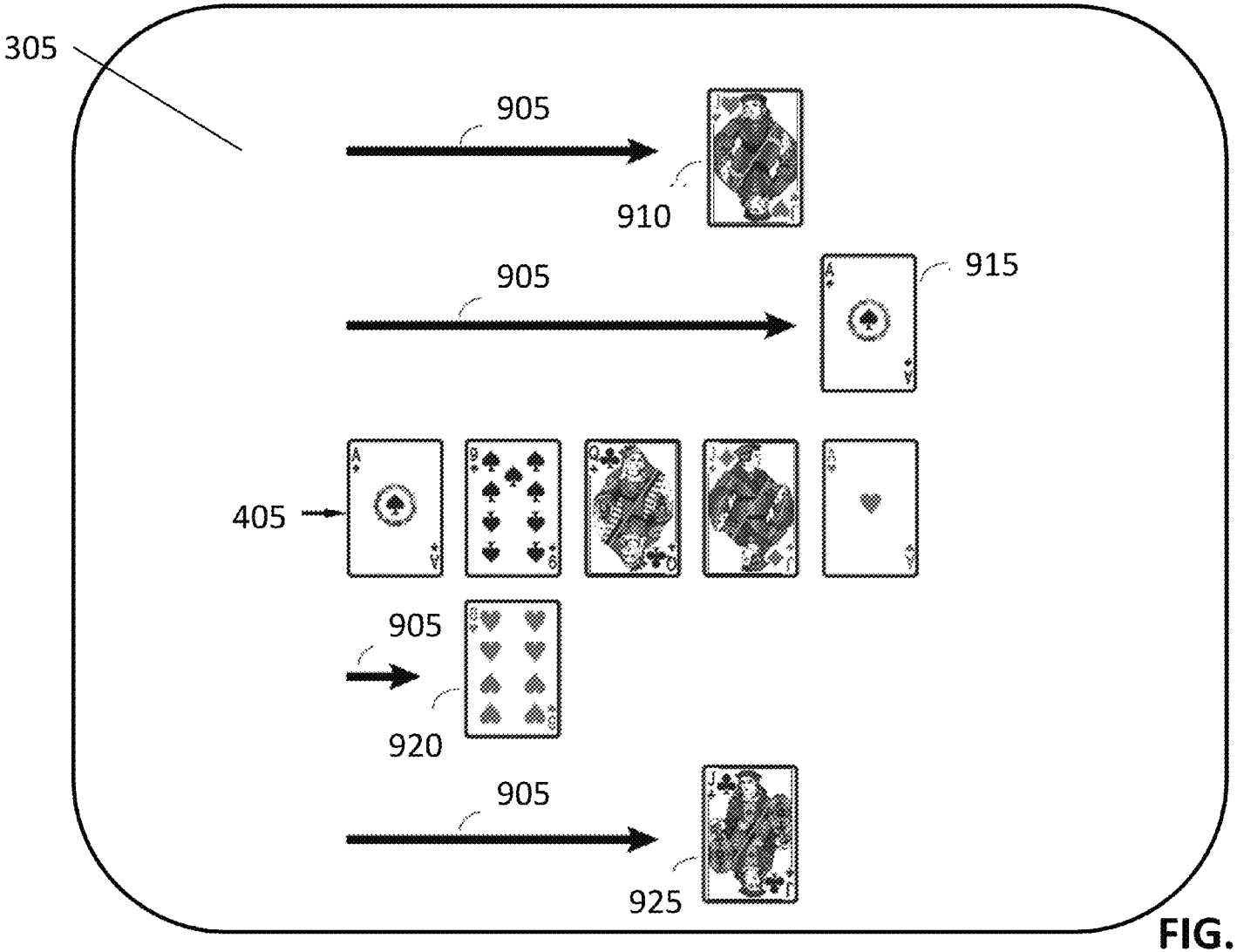
FIG. 9 shows an alternative embodiment of the invention with an initial hand of five cards in a first row and an initial hand of five cards in a first column after the cards in the column have been individually moved to different positions in a grid according to the present invention.
Figure 10:
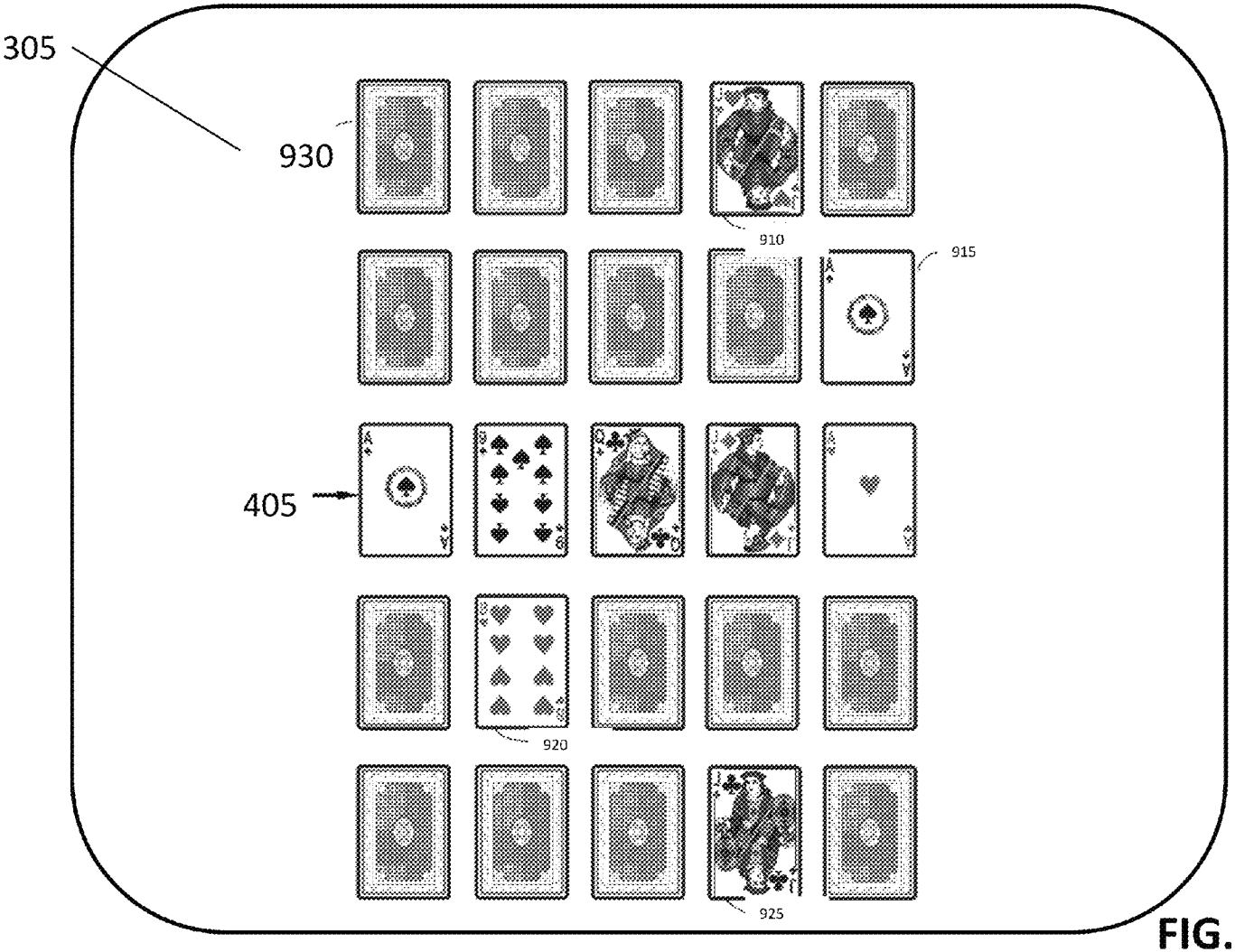
FIG. 10 shows the hands of FIG. 9 after the draw according to the present invention.
Figure 11:
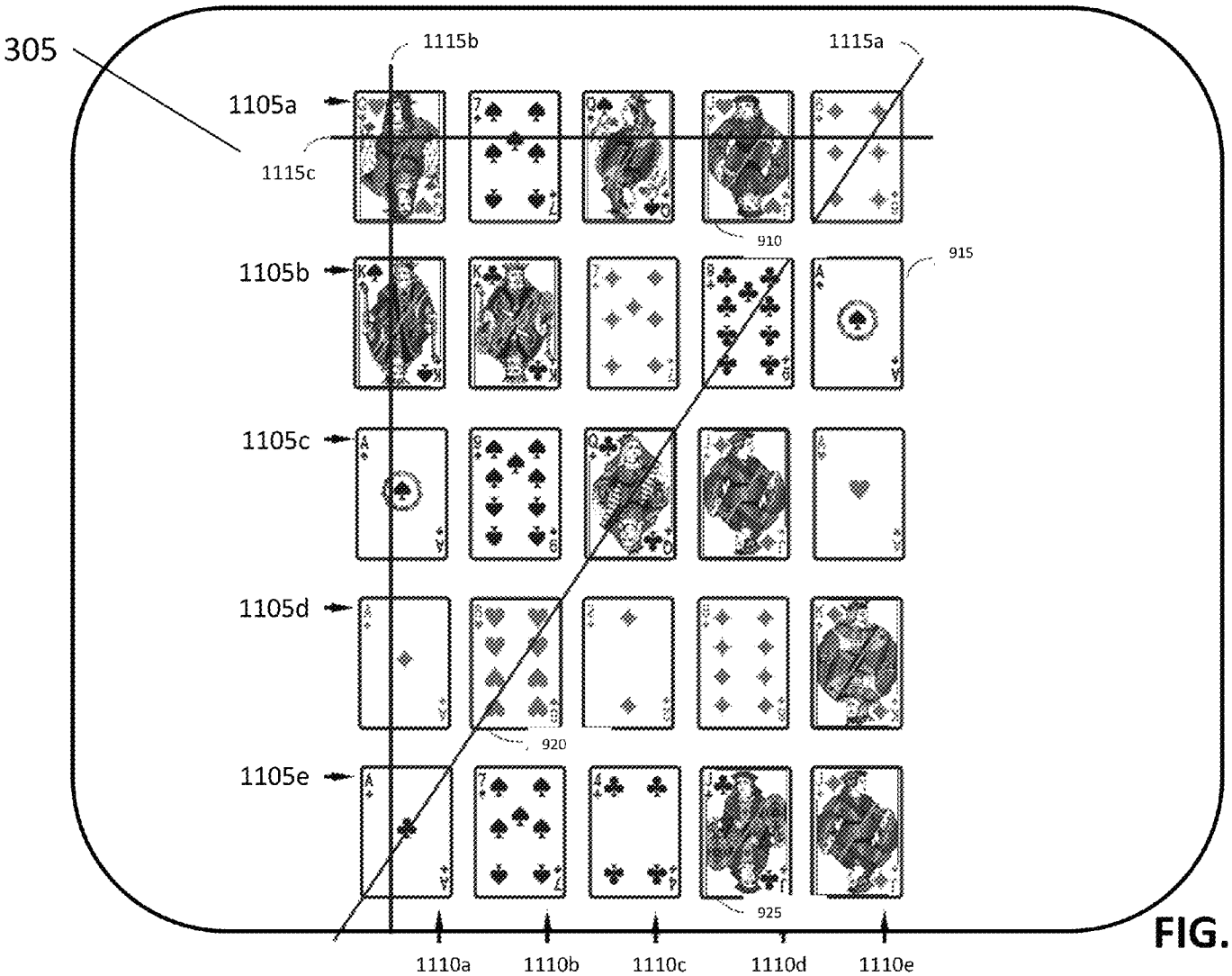
FIG. 11 shows the hands of FIG. 9 after the draw cards are dealt to complete the grid with multiple paylines according to the present invention.

Referring now to FIGS. 9-11, another embodiment of the present invention is shown. In this embodiment, the movement 905 of the cards in column 410 may be initiated and moved by the player individually 910, 915, 920, and 925 rather than moving a column or row of cards all together as shown in the embodiment of FIGS. 4-8. For the draw of cards, each draw card 930 can be dealt either face down then flipped by the player or dealt face-up. In the particular embodiment shown in this sequence of FIGS. 9-11, the draw cards of FIG. 10 are used to "fill in" all of the spaces in a five by five grid.

FIG. 11 shows the five by five grid of FIG. 10 after the cards have been turned over where five row of cards 1105*a*, 1105*b*, 1105*c*, 1105*d*, 1105*e* and five column of cards, 1110*a*, 1110*b*, 1110*c*, 1110*d*, 1110*e* are then evaluated for a winning combination of cards based on a paytable and wager. The paylines 1115*a*, 1115*b*, 1115*c* can be drawn in any possible direction that can create a determinable hand of poker.

Figure 11A:
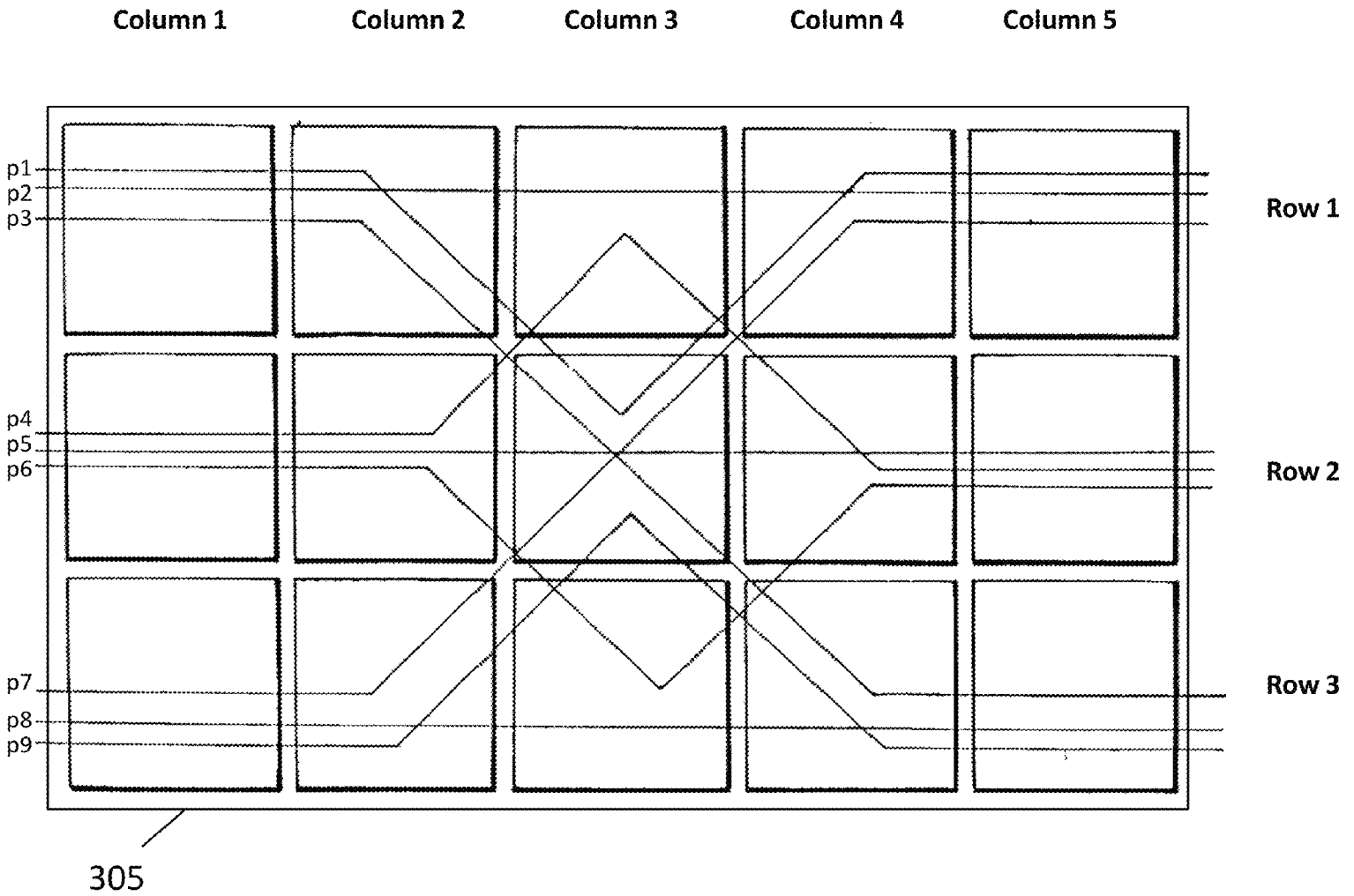
FIG. 11A shows the configuration of sample multiple paylines in a grid that may be used with the present invention.

In the embodiment shown, the method for playing a poker game involves at least twelve hands on straight paylines in the horizontal, vertical and diagonal directions; however, it is possible to implement a similar method of game play using fewer or more hands where any number of paylines cross the grid. For example, paylines may be configured like those used in slot games and referenced as p1-p9 formed across a five by three grid using columns 1-5 and rows 1-3 as shown in FIG. 11A. Preferably, the game is played with a standard fifty-two card deck for each hand played; however, it is possible in this embodiment that a non-standard deck of cards is used or fewer or more fifty-two card decks are used.

Figure 12:
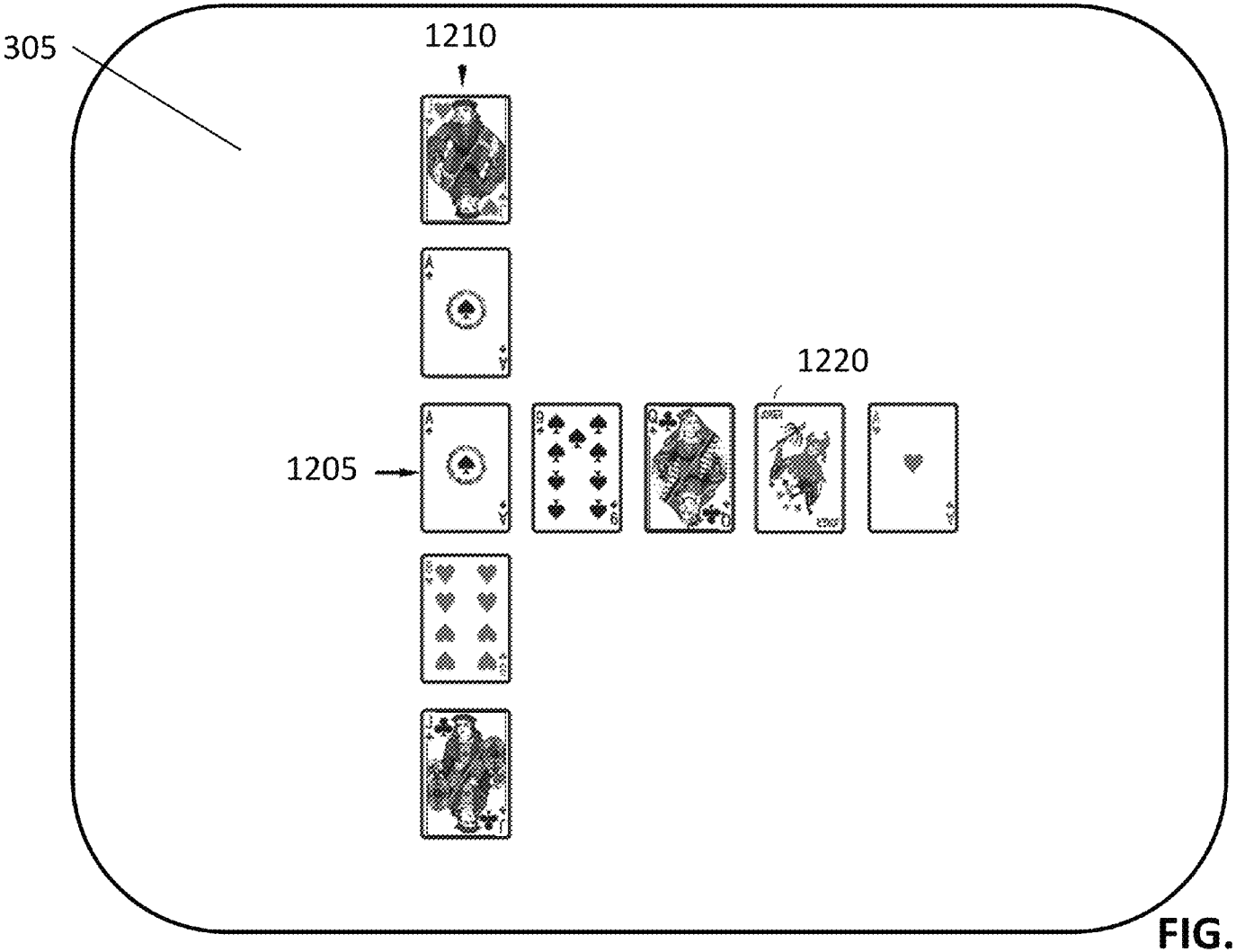
FIG. 12 shows an initial hand of five cards exposed in the a row and an initial hand of five cards a in a column after the initial deal of five cards in each with a wild joker card dealt in the row according to the present invention.
Figure 13:
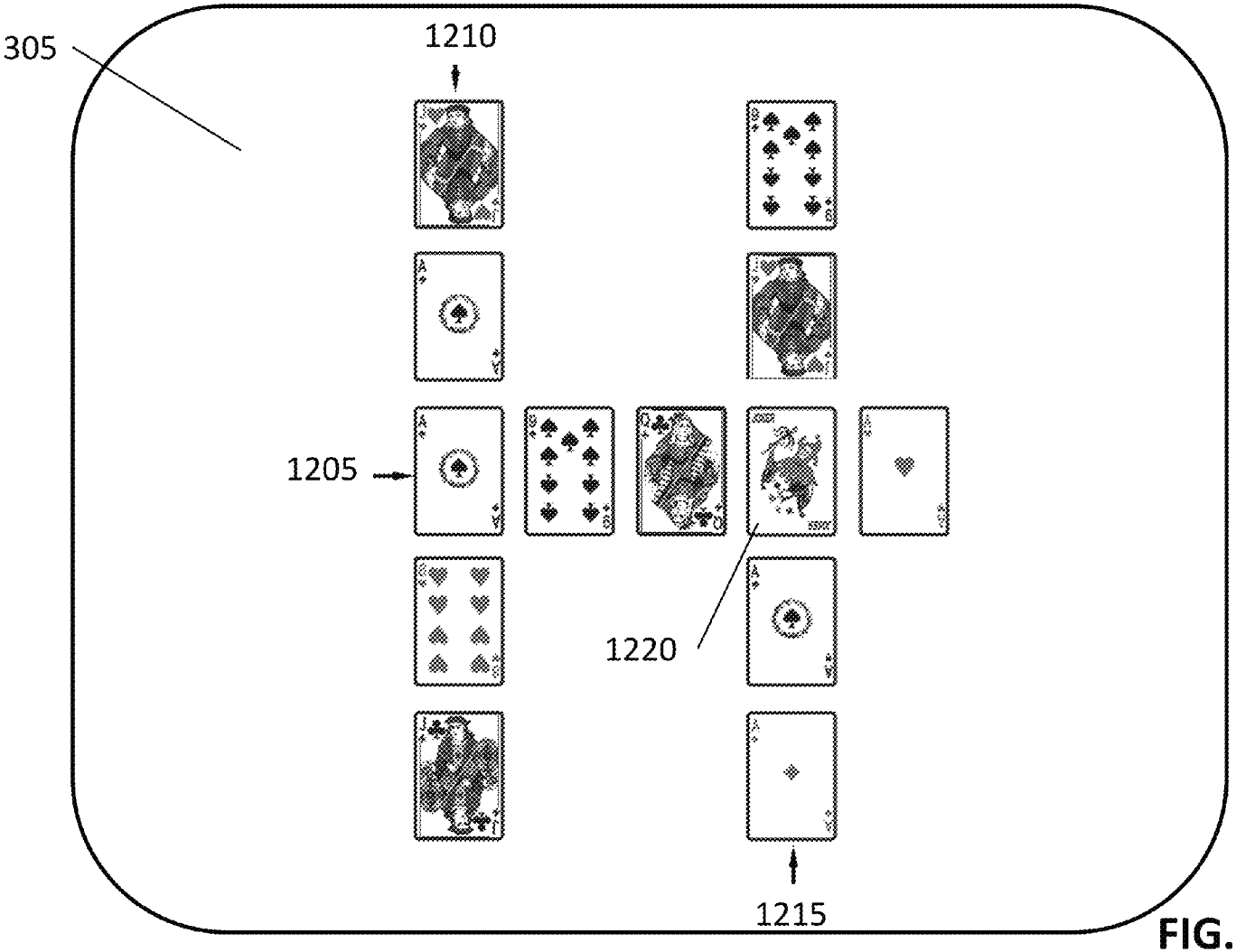
FIG. 13 shows the hands of FIG. 12 with an additional column of five cards from the wild joker card dealt according to the present invention.

Referring now to FIGS. 12-13, another embodiment of the present invention is shown. This embodiment is essentially the same as the embodiment shown in FIGS. 4-8; however, in addition to dealing a row of cards 1205 and a column of cards 1210, a second column 1215 (or alternatively, a second row) is triggered to be dealt based on a bonus event such as a wild card 1220 occurring in row 1205. This embodiment plays in a manner similar to the embodiment of FIGS. 4-8. Once a wild card 1220 is dealt in row 1205 as shown in FIG. 12, a column is dealt intersecting that wild symbol 1220 at column 1215 shown in FIG. 13. The player may then move columns 1210, 1215 and/or row 1205 in order to make a possible winning combination of cards based on a paytable and wager. Sliding columns 1210 and 1215 may be performed using touch and sliding motions on touchscreen 305 where columns 1210 and 1215 may slide into any position along row 1205. The two columns could even be simultaneously aligned with a single card in row 1205. Or, alternatively, columns 1210 and 1215 may be limited based on the position of the other column. For example, a game designer may decide to require that column 1210 be positioned to the left of column 1215 along row 1205.

While it is possible to implement this embodiment with the wild symbol triggering an additional column (or row) without an additional payment or wager, it is also possible to "charge" a player to play for triggering a bonus column (or row) when wild symbol 1220 appears. In this embodiment, the method for playing a poker game involves at least three possible hands depending whether the player received a bonus or wild card 1220 and/or initiated a side bet to unlock the movement of the additional hand of cards in column 1215. It should be understood that it is possible to implement a similar method of game play using fewer or more hands, and it is further possible to implement a similar method of game play using fewer of more bonus or wild cards and side bets. Preferably, the game is played with a standard fifty-two card deck for each hand played; however, it is possible in an alternative embodiment that a non-standard deck of cards is used or fewer or more fifty-two card decks.

It is to be understood that the above descriptions and drawings are only for illustrating representative variations of the present invention and are not intended to limit the scope thereof. Any variation and derivation from the above description and drawings are included in the scope of the present invention. For example, it is also possible to allow the movement of the cards in a hand upon completion of the hand after the draw cards are dealt. This may be an additional step in the sequence of play following the opportunity to move hands after the initial deal, or the movement of hands after completion of the hand may be the only opportunity to move the hands and it may be offered instead of movement after the initial deal.

What is claimed is:

1. A method of playing a poker game on an electronic gaming machine ("EGM") including a processor for controlling the EGM, a display device, an accepting device configured to accept a physical item associated with a monetary value, the monetary value establishing a credit balance, the credit balance being increasable and decreasable based at least on wagering activity, a cashout device configured to receive an input to cause an initiation of a payout associated with the credit balance, a non-transitory memory device having computer-executable instructions and a random number generator ("RNG") program for supplying random numbers to the processor stored thereon, the method comprising:

receiving, by the processor, a wager amount placed for play of the poker game, the wager amount decreasing the credit balance;

generating, via the RNG program, a first set of one or more random numbers that are used by the processor to provide a first random set of at least three cards to be displayed on the display device and representing a first dealt poker hand from a first deck of cards, wherein the first dealt poker hand is presented along a first axis;

generating, via the RNG program, a second set of one or more random numbers that are used by the processor to provide a second random set of at least three cards to be displayed on the display device and representing a second dealt poker hand from a second deck, wherein the second dealt poker hand is presented along a second axis intersecting the first axis, and wherein the second dealt poker hand shares at least one common card with the first dealt poker hand at a first intersection of the first and second dealt hands across the first and second axes;

providing, by the processor, an opportunity to a player to change the common card shared between the first dealt poker hand and the second dealt poker hand displayed on the display device, wherein the opportunity comprises the player, via an input device coupled to the EGM, sliding the first dealt poker hand in a direction parallel across either one of the first or second axis, thereby confirming a selection of the common card upon reaching a desired common card to be held in both the first dealt poker hand and the second dealt poker hand, the desired common card being a second intersection of the first and second dealt poker hands across the first and second axes;

allowing, by the processor, the player to select which cards from the first dealt poker hand and the second dealt poker hand to hold or discard;

discarding, by the processor, zero or more discard cards selected by the player from the first dealt poker hand and the second dealt poker hand;

removing, by the processor, the discarded cards from the first dealt poker hand and the second dealt poker hand;

generating, via the RNG, a third set of one or more random numbers that are used by the processor to provide one or more draw cards from the first deck to replace any of the discarded cards of the first dealt poker hand to create a first completed poker hand, and presenting the first completed poker hand on the display device;

generating, via the RNG, a fourth set of one or more random numbers that are used by the processor to provide one or more draw cards from the second deck to replace any of the discarded cards of the second dealt poker hand to create a second completed poker hand, and presenting the second completed poker hand on the display device, wherein the first and second completed poker hands share the desired common card at said second intersection;

determining, by the processor, whether the first completed poker hand includes a first winning combination; and determining, by the processor, whether the second completed poker hand includes a second winning combination;

increasing, by the processor, the credit balance by any award associated with the first and second winning combinations; and detecting, by the processor, the input to cause the initiation of the payout, via the cashout device.

2. The method of claim 1, further comprising:

generating, via the RNG, a fifth set of one or more random numbers that are used by the processor to select a random set of at least three cards dealt from a third deck of cards to be displayed on the display device and representing a third dealt poker hand, wherein a second common card is shared between the third dealt poker hand and one of either the first dealt poker hand or the second dealt poker hand;

providing, by the processor, an opportunity to the player to change the second common card shared between the third dealt poker hand and at least one of either the first dealt poker hand or the second dealt poker hand displayed on the display device;

allowing, by the processor, the player to select which cards from the third dealt poker hand to hold or discard;

discarding, by the processor, zero or more discard cards selected by the player from the third dealt poker hand;

removing, by the processor, the discarded cards from the third dealt poker hand;

generating, via the RNG, a sixth set of one or more random numbers that are used by the processor to select one or more draw cards from the third deck to replace any of the discarded cards of the third dealt poker hand to create a third completed poker hand, and presenting the third completed poker hand on the display device;

determining, by the processor, whether the third completed poker hand includes a third winning combination.

3. The method of claim 1, wherein the wager amount is received from the player and the credit balance is associated with the player.

4. The method of claim 1 wherein the first dealt poker hand and the second dealt poker hand are displayed in alignment perpendicular to each other with the common card at the intersection between the first dealt poker hand and the second dealt poker hand.

5. An apparatus for playing a video poker game comprising:

at least one display device;

at least one input device;

an accepting device configured to accept a physical item associated with a monetary value, the monetary value establishing a credit balance, the credit balance being increasable and decreasable based at least on wagering activity;

a cashout device configured to receive an input to cause an initiation of a payout associated with the credit balance;

a non-transitory memory device configured to store computer-executable instructions, a random number generator ("RNG") program for supplying random numbers, and a plurality of decks of cards; and a processor connected to the display device, the input device, the accepting device, the cashout device, and the non-transitory memory device, wherein the processor executes the computer-executable instructions and receives one or more sets of random numbers from the RNG to conduct a session of the video poker game to:

receive a wager amount placed for play of the session of the video poker game, the wager amount decreasing the credit balance;

display, on the display device, a first poker hand, along a first axis, having at least three cards dealt from a first deck of cards, the at least three cards of the first poker hand being selected at random using a first set of one or more random numbers received from the RNG program;

display, on the display device, a second poker hand, along a second axis, having at least three cards dealt from a second deck of cards, the at least three cards of the second poker hand being selected at random using a second set of one or more random numbers received from the RNG program, wherein the second axis intersects the first axis, and wherein the second dealt poker hand shares at least one common card with the first dealt poker hand at a first intersection of the first and second dealt poker hands across the first and second axes;

provide an opportunity to a player to change the common card shared between first dealt poker hand and the second dealt poker hand displayed on the display device, wherein the opportunity comprises the player, via the at least one input device, sliding the first dealt poker hand in a direction parallel across either one of the first or second axis, thereby confirming a selection of the common card upon reaching a desired common card to be held in both the first dealt poker hand and the second dealt poker hand, the desired common card being a second intersection of the first and second dealt poker hands across the first and second axes;

allow the player to select which cards from the first dealt poker hand and the second dealt poker hand to hold or discard;

discard zero or more discard cards selected by the player from the first dealt poker hand and the second dealt poker hand;

remove the discarded cards from the first dealt poker hand and the second dealt poker hand;

cause the RNG program to generate a third set of one or more random numbers, using the third set of one or more random numbers to select one or more draw cards from the first deck to replace any of the discarded cards of the first dealt poker hand to create a first completed poker hand, and presenting, on the display device, the first completed poker hand;

cause the RNG program to generate a fourth set of one or more random numbers, using the fourth set of one or more random numbers to select one or more draw cards from the second deck to replace any of the discarded cards of the second dealt poker hand to create a second completed poker hand, and presenting, on the display device, the second completed poker, wherein the first and second completed poker hands share the desired common card at said second intersection;

determine whether the first completed poker hand includes a first winning combination;

determine whether the second completed poker hand includes a second winning combination;

increasing the credit balance by any award associated with the first and second winning combinations; and detect the input to cause the initiation of the payout, via the cashout device.

6. The apparatus of claim 5, wherein the processor further conducts the session of video poker game to:

display, on the display device, a third poker hand having at least three cards dealt from a third deck of cards, the at least three cards of the third poker hand being selected at random using a fifth set of one or more random numbers received from the RNG program, wherein a second common card is shared between the third dealt poker hand and one of either the first dealt poker hand or the second dealt poker hand;

providing an opportunity to the player to change the second common card shared between the third dealt poker hand and at least one of either the first dealt poker hand or the second dealt poker hand displayed on the display device;

allowing the player to select which cards from the third dealt poker hand to hold or discard;

discarding zero or more discard cards selected by the player from the third dealt poker hand;

removing the discarded cards from the third dealt poker hand;

causing the RNG program to generate a sixth set of one or more random numbers, using the sixth set of one or more random numbers to select one or more draw cards from the third deck to replace any of the discarded cards of the third dealt poker hand to create a third completed poker hand, and presenting, on the display device, the third completed poker hand;

determining whether the third completed poker hand includes a third winning combination.

7. The apparatus of claim 5, wherein the wager amount is received from the player and the credit balance is associated with the player.

8. The apparatus of claim 5 wherein the processor conducts a session of video poker games wherein the first hand dealt poker hand and the second dealt poker hand are displayed in alignment perpendicular to each other with the common card at the intersection between the first dealt poker hand and the second dealt poker hand.

9. The apparatus of claim 5, wherein the apparatus is selected from the following list: (a) an electronic gaming machine of the type used in a casino establishment; (b) a poker table game; (c) an electronic table game with a live dealer; (d) an electronic table game with a video dealer; (e) a smartphone; (f) a laptop computer; (g) a desktop computer;

(h) a tablet computer; (i) a PDA, (j) a netbook computer; (i) an electronic game console; or (j) a networked terminal connected to a server.

* * * * *